United States Patent [19]

Speer

[11] 4,261,481

[45] Apr. 14, 1981

[54] FLUID PACKAGING KIT FOR PRESSURIZED DISPENSING

[75] Inventor: Spencer J. Speer, Ontario, Calif.

[73] Assignee: General Dynamics, Pomona, Calif.

[21] Appl. No.: 932,054

[22] Filed: Aug. 8, 1978

[51] Int. Cl.[3] ..... B67D 5/56

[52] U.S. Cl. ..... 222/135; 222/145

[58] Field of Search ..... 222/562, 513, 482, 137, 222/145, 389, 498, 135, 373, 394, 545, 572, 574; 220/288, 306; 239/373

[56] References Cited

U.S. PATENT DOCUMENTS

| | | | |
|---|---|---|---|
| 2,192,082 | 2/1940 | Hunicke | 222/394 X |
| 2,301,718 | 11/1942 | Thorne | 239/373 X |
| 2,844,363 | 7/1958 | Clark | 220/288 X |
| 2,962,187 | 11/1960 | Morris | 220/306 |
| 3,117,696 | 1/1964 | Herman et al. | 222/137 |
| 3,144,966 | 8/1964 | Cook | 222/136 |
| 3,166,221 | 1/1965 | Nielsen | 222/145 X |
| 3,311,265 | 3/1967 | Creighton et al. | 222/137 |
| 3,366,290 | 1/1968 | Mojonnier et al. | 222/572 |
| 3,587,982 | 6/1971 | Campbell | 222/145 X |
| 3,603,487 | 9/1971 | Cook | 222/389 |
| 4,014,463 | 3/1977 | Hermann | 222/145 |
| 4,040,420 | 8/1977 | Speer | 128/218 |

*Primary Examiner*—Stanley H. Tollberg

*Attorney, Agent, or Firm*—Henry M. Bissell; Edward B. Johnson

[57] ABSTRACT

A molded, disposable fluid container is disclosed for containing one, or preferably two, fluids ready for shipping. For a single fluid, the container may be tube-shaped having one or two open ends of smaller diameter. They may be closed by disposable, molded caps which may be screwed over external screw threads, or snapped on and off from molded, external ridges. One of the caps may be of large diameter to correspond to the diameter of the tube, and may in turn, have a small diameter open cylinder which may be closed by a disposable, molded cap. Preferably, dual container kits are used for shipping two fluids. Both containers have a matching, small open end providing with matching ridges or screw threads. This permits metering of the two fluids in a desired ratio through blow-down by appropriate fluid pressures.

7 Claims, 7 Drawing Figures

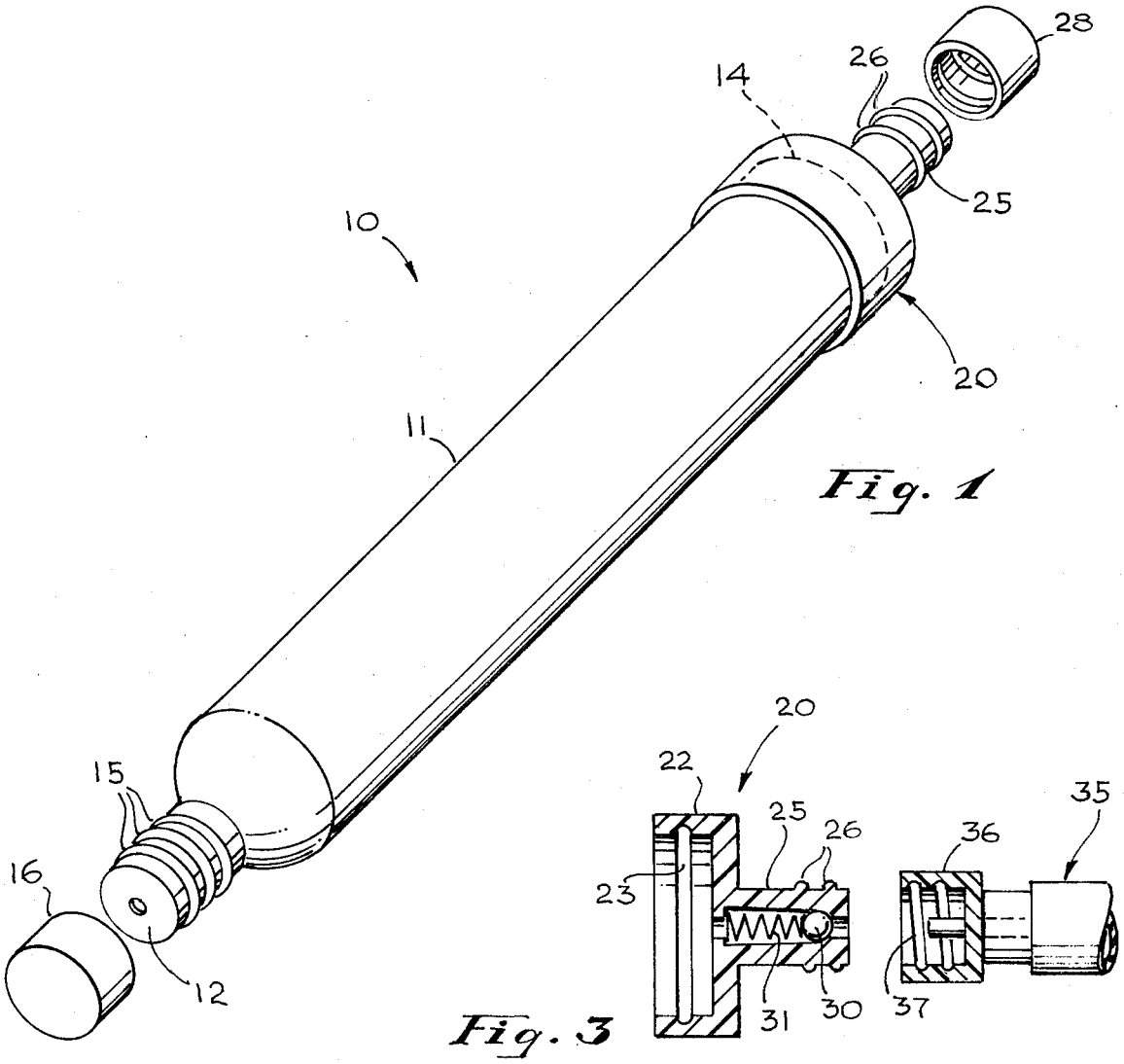
Fig. 1
Fig. 3
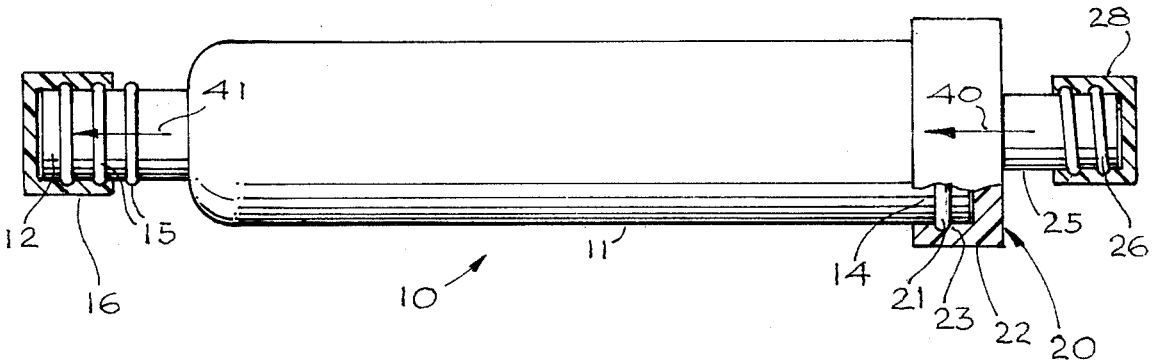
Fig. 2

FLUID PACKAGING KIT FOR PRESSURIZED DISPENSING

BACKGROUND OF THE INVENTION

1. Field of the Invention

The present invention relates generally to a fluid packaging kit for containing and shipping fluids, and more particularly relates to such a kit for containing two fluids to be subsequently ejected and mixed.

2. Description of the Prior Art

It has been a long-standing problem to provide a packaging kit for packaging or containing a two-part fluid, such as a liquid or semi-liquid. In this context, a semi-liquid contains a high concentration of solids such, for example, as an epoxy which may be loaded with powdered metal. Many of such two-part fluids require mixing immediately before use, and precise metering in predetermined proportions. Among examples are epoxy compounds which, when mixed, will harden in a very short period of time. Other examples are certain pharmaceuticals which may have to be precisely metered and mixed or applied at the same spot to provide synergistic action. Some of these liquids or semi-liquids are very viscous; others are not.

It is therefore desirable to provide shipping containers which preferably are disposable, for shipping, and subsequently mixing, and metering such fluids within a large range of viscosities.

In this connection, reference is made to the applicant's prior U.S. Pat. No. 4,040,420 which discloses such a packaging and dispensing kit. However, the kit disclosed in the applicant's prior patent requires pistons for ejecting the fluid contained in twin containers. It has been found that it is very difficult to precisely meter two fluids in a wide range of desired proportions by means of pistons. Generally the operator may not be dexterous enough to move simultaneously two pistons at different speeds. On the other hand, mechanical arrangements may be used to move simultaneously the two pistons at a different speed. Such arrangements, however, must be infinitely variable to suit the many purposes for which they may be used; they are complicated, hence expensive and cumbersome.

In this connection, reference is made to a patent to Nielsen, U.S. Pat. No. 3,166,221 which also uses two pistons. In this particular case, it is not possible to vary the dispensing ratios without also varying the container volumes because the two pistons or plungers are connected to each other.

Reference is also made to the patent to Hermann, U.S. Pat. No. 4,014,463 entitled, "Plural Component Dispenser". The dispenser disclosed in this patent is provided with two rugged chambers, each filled with one of the fluids and having a piston movable through the length of the chamber to force the fluids out through exit ports. The chambers are arranged in tandem, whereby one chamber acts as a piston for the other in a telescoping action. Also, a detachable mixer nozzle is disclosed for mixing the two fluids.

Also the patent to Cook, U.S. Pat. No. 3,144,966 discloses a dual container and a hollow plunger tube. In addition, the mixing is facilitated by a dasher plate in the container.

Various other patents feature a plunger actuated by a pistol-like grip. Such constructions are shown by the caulking assembly of Sherbondy, U.S. Pat. No. 3,189,226, or the gun for two component adhesives revealed by the patent to Hermann et al., U.S. Pat. No. 3,117,696, and to Creighton, Jr., et al., U.S. Pat. No. 3,311,265, and the adhesive and sealant dispenser disclosed in the patent to Campbell, U.S. Pat. No. 3,587,982, which is additionally provided with a grinding action.

SUMMARY OF THE INVENTION

In accordance with the present invention, there is provided a molded fluid container. The container may have a single tube-like main structure or, preferably, it consists of two identical, tube-like containers, each for containing one of the fluids of a two-part mixture. The tube-like main structure has two open ends and consists of a moldable plastic. Means are provided, such as ridges or screw threads, on both open ends of the tube for removably retaining a closure cap. The two closure caps are also molded from a plastic.

Hence a fluid, such as a liquid or semi-liquid, may be contained in the container and may be shipped therein. Afterward, the end caps may be removed, whereby the fluid in the container is forced by fluid pressure applied to one end so that it flows out the other end.

In the case of two elongated, tube-like structures which may be identical, each of the structures has an open end portion with a semicircular ridge or screw thread mating with the corresponding ridge of the other structure. Hence, a single cap may be snapped over the ridges, and may readily be removed preparatory to ejecting and mixing the two fluids.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

BRIEF DESCRIPTION OF THE DRAWINGS

FIG. 1 is a perspective view of a molded container tube embodying the invention and provided with two cylindrical end portions, one having a reduced diameter, which have externally molded-on threads or ridges for removably securing thereto end caps;

FIG. 2 is a side elevational view of the embodiment of the invention of FIG. 1 showing one open end of reduced diameter with a removable end cap shown in section, while the other end of the container may be provided with a pressure cap assembly which in turn may be closed by an end cap shown in section;

FIG. 3 is a sectional view of the pressure cap assembly of FIG. 2, also illustrating a pressure hose and connection therefor;

DESCRIPTION OF THE PREFERRED EMBODIMENT

Figure 4:
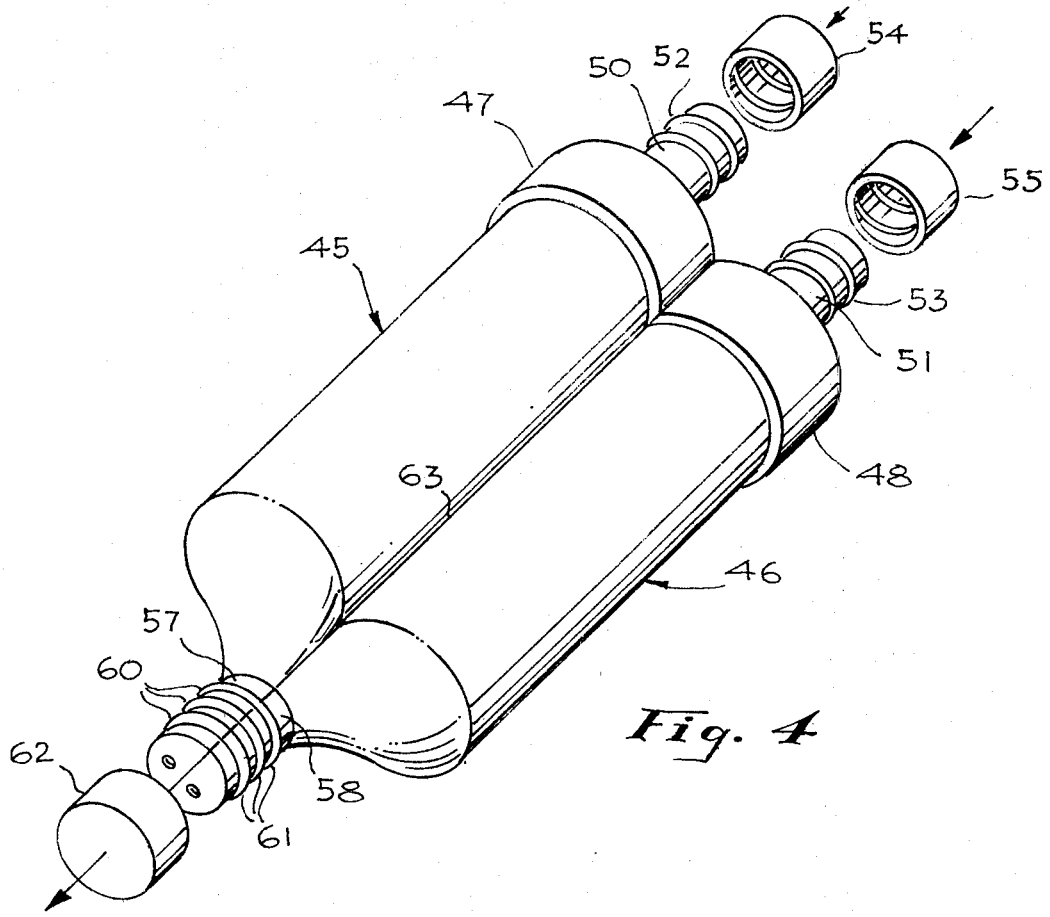
FIG. 4 illustrates in perspective a preferred embodiment of the invention including twin tubes, each for containing one component of a two-part mixture, the two tubes having a common end with a common external ridge.

Referring now to the drawings and particularly to FIGS. 1–3, there is illustrated an embodiment of the present invention. As shown in FIGS. 1 and 2, the molded fluid container 10 consists of a hollow, tube-like structure 11 having an open end 12 of reduced diameter and another end 14 which is simply an extension of the tube-like main body 11.

The open end 12 of reduced diameter is provided with external ridges 15 which are molded, as is the entire body 11. An end cap 16 having a suitable, internal recess or recesses of annular form is adapted to snap on over the ridges 15. It will, however, be understood that instead of providing externally molded ridges 15, corresponding externally molded screw threads may be used instead. In this case, the end cap 16 should have corresponding internal screw-shaped grooves to mate with the external screw threads 15.

Disposed over the other open end 14 of the main tube 11 is another cap structure or assembly 20 which optionally may contain a one-way valve, as will be explained in connection with FIG. 3. The large diameter, open end 14 may again be provided with an external, molded ridge 21 which mates with the large diameter cap portion 22 having a suitable internal, annular recess 23 for receiving the ridge 21. The end cap structure 22 in turn, has an open end 25 of reduced diameter which may be provided with externally molded screw threads 26. The end cap 28 in turn, is provided with internal screw-shaped grooves to mate with the external screw threads 26 of the end cap structure 20.

The end cap structure 20, is clearly shown in FIG. 3. Optionally it may be provided with a one-way, spring-loaded valve. The valve consists of a ball 30, and a spring 31 urging the ball 30 against a seat in the reduced end portion 25. The spring 31 bears against a suitable shoulder in the end portion 25.

Hence, it will be realized that when the cap structure 20 of FIG. 3 is seated, as shown in FIG. 2, it will prevent a fluid in the container 10 from leaking out. On the other hand, when the end cap 16 is removed by pulling it off or unscrewing it, the fluid in the container 10 may be removed by applying air or fluid pressure to the cap structure 20. To this end, the end cap 28 is first removed; then a pressurization hose 35 is applied to the end portion 25 of the structure 20. The pressurization hose 35 is provided with a suitable coupling 36 consisting of a cylindrical structure having internal recesses 37 capable of mating with the threads 26 on the small end 25 of the cap structure.

It will be realized that the pressurization hose 35 may be connected to any suitable source of air or fluid supply. This may either be an available source of pressurization which is usually found in many places, or else it may be connected to a suitable compression pump or the like. When connected in this manner, the fluid in the container 10 will be forced outwardly, as shown by the arrows 40 and 41 in FIG. 2.

Preferably, the container 10, its end caps 16 and 28, and its end cap structure 20 are molded of some suitable plastic. A preferred, moldable plastic is polypropylene. Alternatively, polyethylene may be used. In some cases, somewhat harder and stiffer, moldable plastic materials may be desired, such as acrylic or polystyrene.

In any case, the container of the invention is capable of handling fluids, such as liquids or semi-liquids, having a wide range of viscosities. The reason is that the fluid in the container body 11 may be forced out by sufficient air or fluid pressure to drive the fluid out regardless of how high its viscosity may happen to be.

It will also be realized that the structure shown in FIGS. 1 and 2 may be packaged with a suitable fluid and then shipped to its point of use where it may be dispensed and then discarded.

Frequently it is desired to dispense and mix at the point of application a two-part, fluid compound. Among these are certain epoxy compounds which harden rapidly when mixed. Among other applications are certain pharmaceuticals which may have to be applied at the same point to obtain a synergistic effect. In many cases, the two fluids have to be precisely metered in predetermined properties. This may, for example, be effected with the structure of FIG. 4 illustrating a preferred embodiment of the present invention.

The embodiment of FIG. 4 is a dual container kit with identical tube structures 45 and 46. Each of the tubes 45 and 46 is generally similar to that of FIG. 1 and may include a cap structure, such as shown at 20 in FIG. 1. Thus, each container 45, 46 is provided with its own cap structure 47, 48. Optionally, each of the cap structures may be provided again with a one-way, spring-loaded valve. Each of the reduced end portions 50 and 51 is provided with externally molded ridges 52, 53, or screw threads for removably securing thereto a disposable cap 54, 55.

Each of the dual tube-like structures 45, 46 has an end portion 57, 58 of reduced diameter, which is disposed adjacent to the other. Accordingly, each end portion 57, 58 may for example, be provided with semicircular ridges 60, 61. Hence, a corresponding single end cap 62 is capable of being snapped on and off over the ridges 60, 61.

Preferably, but not necessarily, the dual tube structure 45, 46 may have adjacent flat walls, as indicated at 63, so that they are reinforced for rigidity or secured against rotation.

The structure of FIG. 4 is a preferred embodiment of the invention. It makes it possible to deliver two fluids having a desired mixing ratio. This may be effected by controlling the air and fluid pressure applied to each of the structures 45 and 46 separately. This in turn, will provide a different delivery rate from each of the two tubes. It is also possible that each of the tubes contains a different volume of fluid. This again will make it possible to deliver different ratios of the two fluids, depending on the desired end use.

Since the entire structure is made of a molded plastic material, it becomes economical to discard the entire structure, including all end caps, after usage. This eliminates the necessity of cleaning out the tubes. Again, the structure of FIG. 4 when filled with the respective fluids, can be capped and shipped with tear-off, disposable caps at the delivery end.

The air pressure or fluid pressure may be applied, as shown in connection with FIG. 3.

It will be understood that the pressure regulation may be preset or varied. This depends on the desired fluid volumes, the densities of the fluids, their viscosities, the desired delivery rate, or the mixing ratio that is desired.

It will also be understood that the structures shown in FIGS. 1–4 may be utilized for directly dispensing a single or two-part fluid to the end use. Preferably, however, particularly where a two-part fluid component is involved, and the structure of FIG. 4 is used, it may be desired to mix the two fluids before they are being used.

Figure 5:
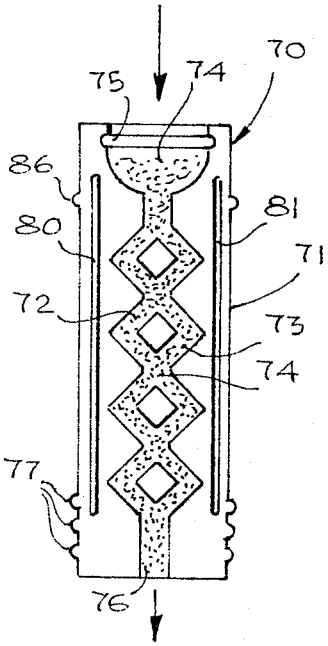
FIG. 5 illustrates, in front elevation, one half of a molded mixing container which may be used with the container of the invention.
Figure 6:
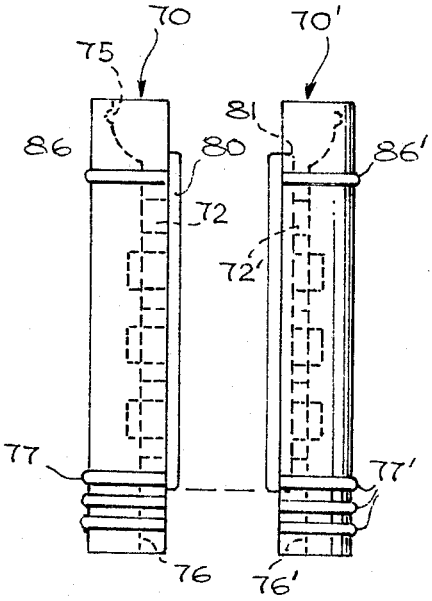
FIG. 6 is a side elevational view of two mirror image portions comprising the complete mixing device.
Figure 7:
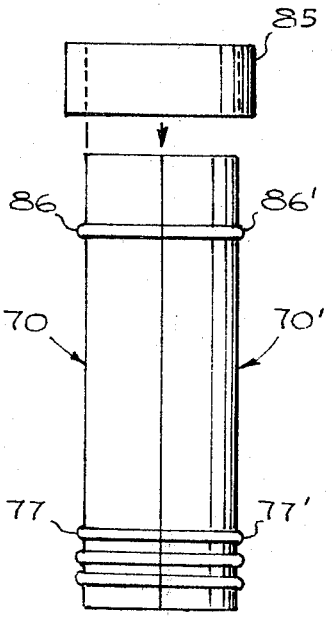
FIG. 7 is an exploded view of the assembled mixer of the invention and a retaining ring therefor.

Such a mixing device has been illustrated in FIGS. 5–7 by way of example. It will be understood, however, that the mixing device of FIGS. 5–7 while disclosed herein, is not claimed in the present application; it is also disclosed and claimed in the applicant's copending application, Ser. No. 932,053, filed simultaneously herewith.

Referring now to FIGS. 5–7, there is illustrated a mixing device for simultaneously dispensing a two-part fluid compound obtained from the packaging kit of the present invention, particularly that of FIG. 4. FIG. 5 illustrates a front elevation of one half of the two-part mixing device. The one part 70 may again be molded of a plastic material, as previously explained. It consists of a semi-cylindrical structure 71 having molded therein a tortuous fluid path 72, 73. The two fluid passages 72 and 73 are shown to join each other, as shown at 74, and divide again through a certain length of the structure 70. The tortuous paths thus provided serve the purpose to improve shearing of fluids and mixing thereof. Also, the fluids are folded back upon themselves. The liquid passages may meet each other at right angles or other suitable angles.

Thus, the structure of FIG. 5 may be visualized as being an almost solid, semi-cylinder having suitable passages 72 and 73 therein. The structure 70 is also provided with an input chamber 74 having an internal groove 75 which may mate with the ridges 60, 61 of the structure of FIG. 4. The semicircular structure 70 of FIG. 5 also has an outlet opening 76. It may be provided with external, semicircular ridges 77 for connecting thereto a delivery nozzle which may be of the type disclosed in the applicant's prior U.S. Pat. No. 4,040,420. Additionally, the structure 70 of FIG. 5 may be provided on one side with a male attachment lug 80 and on the other side with a female attachment detent 81.

FIG. 6 shows the two halves of the completed structure which are mirror images of each other and may otherwise be made identical to each other. Corresponding parts of the second half will be designated by primed numbers.

The completed structure is illustrated in FIG. 7. It may be desirable to provide retaining means for the structure of FIG. 7. This may take, for example, the form of a ring 85 having an inner diameter to fit over the outer diameter of the assembled structure of FIG. 7. In this case, each half of the mixing device may be provided with a suitable, semicircular ridge 86 and 86' near its upper portion to retain the ring 85.

There has thus been disclosed a fluid packaging kit for dispensing one or more fluids at a point of delivery. The kit consists of a molded, disposable fluid container which may have a single structure, or preferably, consists of two identical structures, each containing a different fluid. The structure is made of some moldable material and, hence, is disposable after use. It may be used with a mixing device disclosed herein, but claimed in a copending application filed concurrently herewith.

Although there have been described above specific arrangements of a fluid packaging kit for pressurized dispensing in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A molded disposable fluid dispensing container comprising:

(a) a pair of elongated molded tube-like structures, each having two open ends and being mated longitudinally to each other, the first open end of each structure integrally containing fluid exit means of a diameter less than the size of the associated structure, said first open ends cooperating to form an external circular surface, and the other open end of each structure including means for applying a pressurized fluid directly to the dispensable fluid adjacent said other end in order to individually drive said dispensable fluid out of said fluid exit; and (b) plural removably retained caps, a first cap being adapted to seal said first end on each portion of said structure and second and third caps being adapted to close each of said other open ends, said caps sealing said container for shipment.

2. A disposable fluid dispensing container comprising:

(a) a pair of elongated molded tube-like structures, each having two open ends and being mated longitudinally, the first open end of each structure integrally containing fluid exit means of a diameter less than the size of the associated structure, said first open ends cooperating to form an external circular surface, and the other open end of each structure having means for applying a pressurized fluid directly to the dispensable fluid adjacent said other ends in order to individually drive said dispensable fluid out of said fluid exit, each of said pressurized fluid means including an externally operated one-way spring-loaded valve capable of opening under external fluid pressure and allowing fluid entry into said container while preventing fluid exit therefrom, each of said pressurized fluid means being independently controllable; and (b) plural removably retained caps, a first cap being adapted to seal said first end on each portion of said structure and second and third caps being adapted to close each of said other open ends, said caps sealing said container for shipment.

3. A container as defined in claim 1 wherein said removably retained cap on said first end is retained by a semicircular ridge on each structure mating with the corresponding semicircular ridge of the other structure.

4. A container as defined in claim 1 wherein said removably retained cap is retained on said first end by portions of screw threads, the threads on one end portion mating with and completing the threads on the other.

5. A container as defined in claim 1 wherein the large open end portion of each of said structures is provided with a removable, disposable cap assembly element having a large diameter corresponding to the large open end of the associated structure and a reduced diameter open end having externally molded means for removably securing thereto a plastic cap.

6. A container as defined in claim 3 wherein said ridges are externally molded.

7. A container as defined in claim 4 wherein said screw threads are externally molded.

* * * * *